US008083534B2

(12) United States Patent
Pipho et al.

(10) Patent No.: US 8,083,534 B2
(45) Date of Patent: Dec. 27, 2011

(54) ELECTRICAL CONNECTORS CONFIGURED TO PREVENT IMPROPER CONNECTION OF A COMPONENT MODULE

(75) Inventors: David A. Pipho, Tomball, TX (US); Luis C. Armendariz, Spring, TX (US); Abdul Baten, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/919,305

(22) PCT Filed: Apr. 28, 2008

(86) PCT No.: PCT/US2008/061719

§ 371 (c)(1), (2), (4) Date: Aug. 25, 2010

(87) PCT Pub. No.: WO2009/134240

PCT Pub. Date: Nov. 5, 2009

(65) Prior Publication Data

US 2011/0008976 A1 Jan. 13, 2011

(51) Int. Cl.
*H01R 13/62* (2006.01)

(52) U.S. Cl. ..... 439/326

(58) Field of Classification Search ..... 439/326
See application file for complete search history.

(56) References Cited

U.S. PATENT DOCUMENTS

| | | | | |
|---|---|---|---|---|
| 5,803,761 | A | 9/1998 | Mochizuki | |
| 5,933,328 | A * | 8/1999 | Wallace et al. | 361/737 |
| 5,961,338 | A * | 10/1999 | Wu et al. | 439/326 |
| 6,210,193 | B1 * | 4/2001 | Ito et al. | 439/326 |
| 6,334,786 | B1 * | 1/2002 | Lee | 439/331 |
| 6,471,550 | B2 * | 10/2002 | Maiterth et al. | 439/631 |
| 6,736,660 | B2 | 5/2004 | Ku | |
| 6,896,548 | B2 * | 5/2005 | Scuteri et al. | 439/541.5 |
| 7,217,148 | B1 * | 5/2007 | Chen | 439/326 |
| 7,335,044 | B2 * | 2/2008 | Lai et al. | 439/326 |
| 7,393,230 | B2 * | 7/2008 | Yang et al. | 439/326 |
| 7,435,119 | B2 * | 10/2008 | Chang et al. | 439/188 |
| 7,794,258 | B2 * | 9/2010 | Tu et al. | 439/326 |
| 7,833,040 | B2 * | 11/2010 | Huang | 439/326 |
| 2005/0070146 | A1 * | 3/2005 | Lu | 439/326 |
| 2005/0208813 | A1 * | 9/2005 | Trout et al. | 439/326 |
| 2007/0202732 | A1 * | 8/2007 | Yahiro et al. | 439/326 |

FOREIGN PATENT DOCUMENTS

| | | |
|---|---|---|
| JP | 09306612 | 11/1997 |
| JP | 17293990 | 10/2005 |

OTHER PUBLICATIONS

International Searching Authority, International Search Report & Written Opinion dated Jan. 15, 2009, pp. 10.

* cited by examiner

*Primary Examiner* — Gary F. Paumen

(57) ABSTRACT

In one embodiment, an electrical connector adapted to receive a component module includes a body that defines a socket into which the module can be inserted, and an obstruction element adapted to physically interfere with the module when it is attempted to seat the module within the connector with the module only partially inserted into the socket.

20 Claims, 3 Drawing Sheets

ELECTRICAL CONNECTORS CONFIGURED TO PREVENT IMPROPER CONNECTION OF A COMPONENT MODULE

BACKGROUND

Computer component modules, such as memory modules, are often physically and electrically connected to computer motherboards using surface-mounted connectors. In some cases, the connectors comprise a socket that is adapted to receive an edge of a circuit board of the module so that contacts provided along the edge of the circuit board can couple with mating contacts provided within the socket.

The socket-type connector described above functions well when the edge of the module's circuit board has been fully inserted into the socket. Problems can arise, however, when that edge is only partially inserted into the socket. Specifically, although the computer comprising the module may pass testing performed at the factory because the contacts of the circuit board and the connector may still be coupled when the circuit board is only partially inserted, such coupling may be broken when the computer is jarred during shipment or normal use. When that occurs, the computer may not function properly or even may not function at all. Therefore, partial insertion can result in a latent defect that may only be discovered by the computer purchaser.

BRIEF DESCRIPTION OF THE DRAWINGS

The disclosed connectors can be better understood with reference to the following drawings. The components in the drawings are not necessarily to scale.

DETAILED DESCRIPTION

As described above, improper connection of a component module into an associated socket-type connector can result in a latent defect that can adversely affect a computer in which the module is used. Disclosed in the following are connectors that are configured to prevent such improper connection. More specifically, disclosed are surface-mounted connectors that prevent seating of a component module within the connector when the module has only been partially inserted into a socket of the connector. In some embodiments, seating is prevented using one or more obstructions that physically interfere with the module when the module is only partially inserted.

Figure 1:
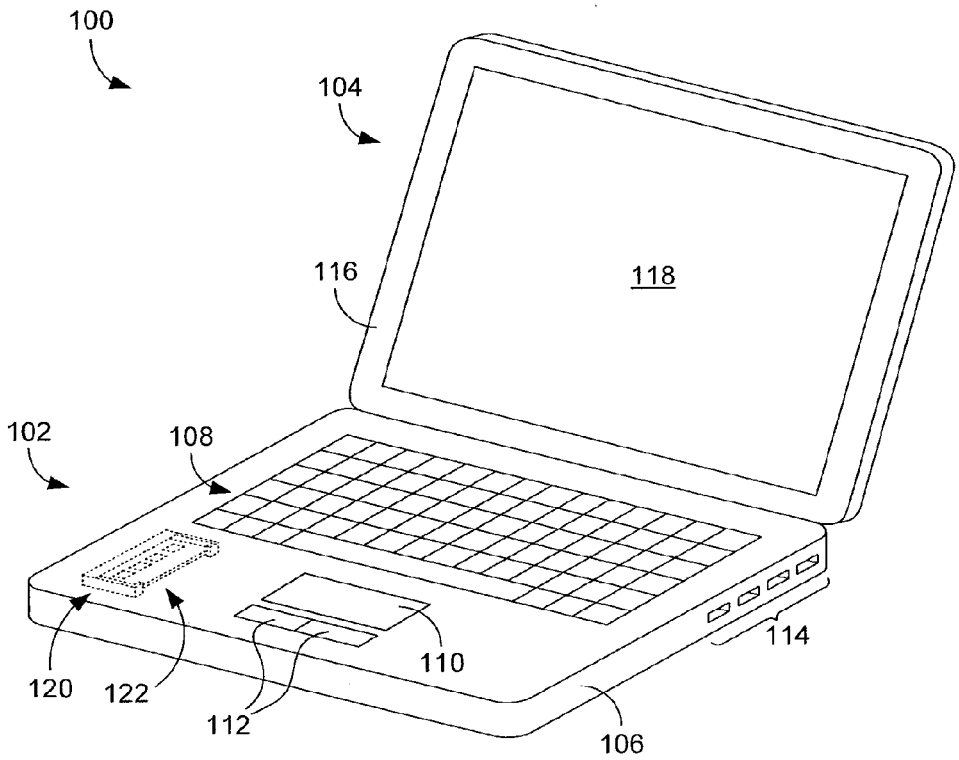
FIG. 1 is a perspective view of an embodiment of a computing device comprising an electrical connector configured to prevent improper connection of a component module.

Referring now in more detail to the drawings in which like numerals indicate corresponding parts throughout the views, FIG. 1 illustrates a computing device 100 in the form of a notebook or "laptop" computer. Although a notebook computer has been explicitly illustrated and identified, it is noted that the notebook computer is cited only as an example. Therefore, the teachings of the present disclosure equally apply to other computing devices, such as server computers, desktop computers, and game consoles.

As indicated in FIG. 1, the computing device 100 includes a base portion 102 and a display portion 104 that are attached to each other with a hinge mechanism (not shown). The base portion 102 includes an outer housing 106 that surrounds various internal components of the computing device 100, such as a processor, memory, hard drive, and the like. Also included in the base portion 102 are user input devices, including a keyboard 108, a mouse pad 110, and selection buttons 112, as well as various ports or connectors 114 that are accessible through the housing 106. The display portion 102 includes its own outer housing 116 that supports a display device 118, such as a liquid crystal display (LCD).

As is further depicted in FIG. 1, the base portion 102 also comprises an internal electrical connector 120 to which a component module 122 is connected. Example embodiments of the connector 120 and the module 122 are described in the figures that follow.

Figure 2:
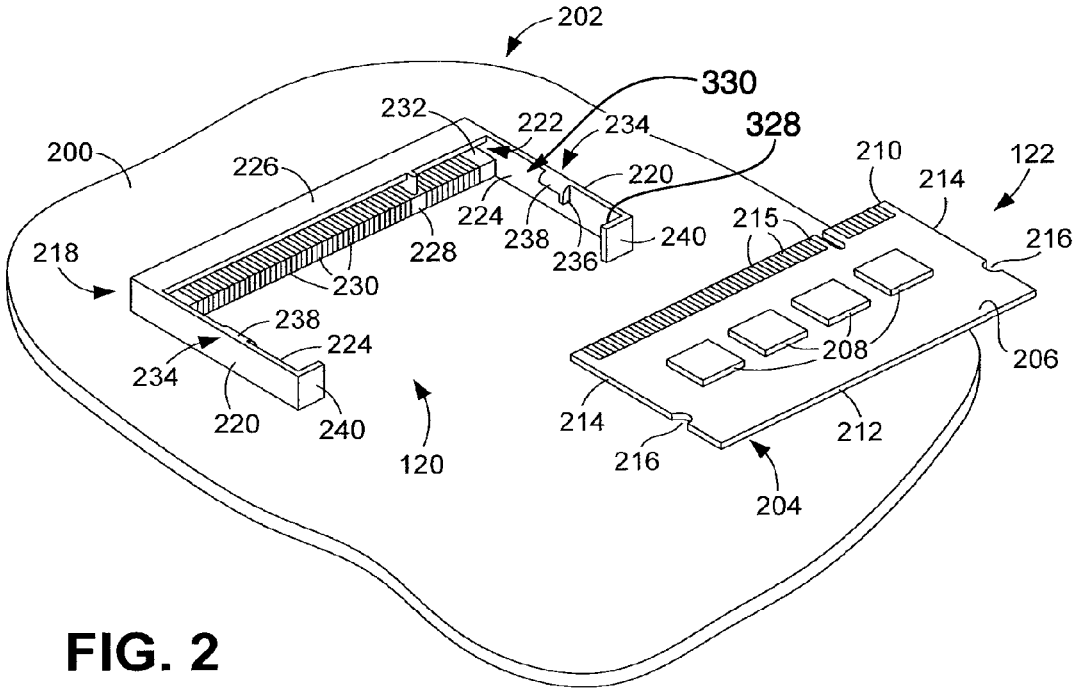
FIG. 2 is a partial perspective view of the connector identified in FIG. 1.

Referring now to FIG. 2, the electrical connector 120 and the component module 122 are shown in greater detail. As indicated in FIG. 2, the connector 120 is mounted to a surface 200 of a circuit board 202. By way of example, the circuit board 202 comprises a motherboard of the computing device 100. As is further indicated in FIG. 2, the module 122 comprises its own circuit board 204 that includes a top surface 206 to which various components 208 are mounted. By way of example, the components 208 comprise random access memory (RAM) chips. In such a case, the module 122 may be referred to as a memory module. The circuit board 204 of the module 122 includes a front edge 210, a rear edge 212, and opposed lateral edges 214. Provided along the front edge 210 are multiple electrical contacts 215. Formed in each of the lateral edges 214 are recesses 216 that, as described below, are used to secure the module 122 to the connector 120.

Figure 3A:
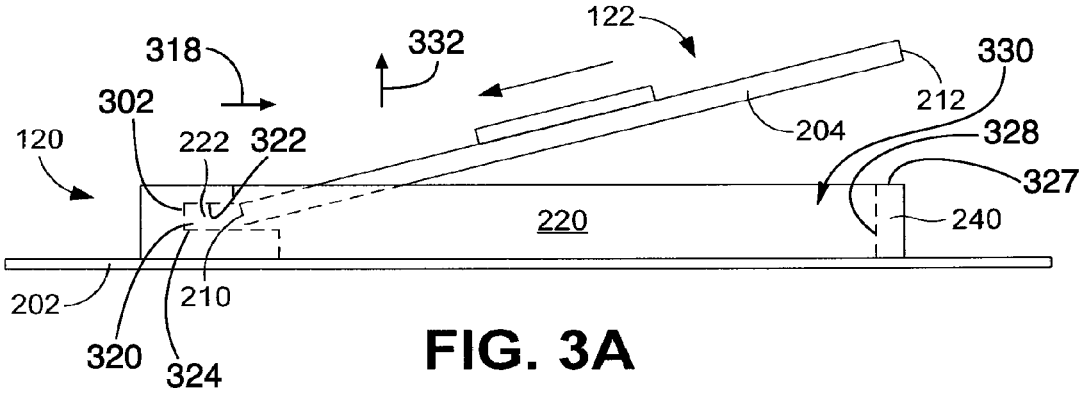
FIGS. 3A-3D are schematic side views of the connector of FIG. 2, illustrating connection of a component module to the connector.

With further reference to FIG. 2, the electrical connector 120 comprises a body 218 and lateral arms 220 that extend out from the body. In some embodiments, the body 218 and arms 220 are unitarily formed from the same piece of material. By way of example, the connector body 218 and arms 220 are formed using an injection molding process. The body 218 comprises a socket 222 that is adapted to receive the front edge 210 of the module circuit board 204. Generally speaking, the socket 222 is defined by inner surfaces 224 of the arms 220, a top cover 226 of the body 218, and a bottom ledge 228, which also forms part of the body. As shown by FIG. 3A, socket 222 has a socket opening 320 are facing in a first direction 318 and which is defined by rear surface 302, upper surface 322 and lower surface 324. The bottom ledge 228 forms the lower surface 324 and comprises integrated electrical contacts 230 that are adapted to mate with the contacts 214 of the component module 122 when the module is inserted into the socket 222. In some embodiments, further electrical contacts (not shown) are integrated into the top cover 226. The bottom ledge 228 further comprises a support or top surface 232 that supports the module 122 when it is inserted into the socket 222.

As is further illustrated in FIG. 2, each lateral arm 220 is formed as a vertical wall and includes a locking element 234 that is adapted to lock down the component module 122 when the module is seated within the electrical connector 120. In the embodiment of FIG. 2, the locking elements 234 comprise tab portions 236 that are adapted for receipt by the recesses 216 of the module circuit board 204 and clip portions 238 that are adapted to snap into place onto the top surface 206 of the circuit board. Provided at the distal end of each arm 220 is an obstruction element 240 that has a top surface 327 and an uncovered vertically exposed cavity surface 328 extending from top surface 327. As shown by FIG. 3A, arms 220 and obstruction element 240 define or form a cavity 330 which faces in a direction 332 perpendicular to direction 318. The orientation shown in FIG. 3A, socket opening 320 faces in a horizontal direction 318 while cavity 330 faces in an upward vertical direction. As described below, obstruction element 240 is used to physically interfere with the circuit board 204 when one attempts to seat the module within the cavity 330 of connector 120 with the circuit board 204 only partially inserted into the socket 222. More particularly, a rear portion of the partially-inserted circuit board 204 abuts against the obstruction elements 240 when an installer attempts to seat the module 122 by positioning the circuit board between the arms 220 and into engagement with the locking elements 234 (see FIG. 3B). In the illustrated embodiment, each obstruction element 240 comprises a wall that is contiguous with its associated arm 228. Although two obstruction elements 240 are shown, it is noted that one continuous obstruction element or wall that extends between the two arms 220 may be used, if desired.

As described above, the component module 122 can be connected to the electrical connector 120 by inserting an edge of the module circuit board 204 into the socket 222. Illustrated in FIGS. 3A-3D are various examples of such insertion. Beginning with FIG. 3A, illustrated is initial insertion of the module 122 into the socket 222 of the connector 120. As indicated in FIG. 3A, the front edge 210 of the circuit board 204 is introduced into the socket 222 with the circuit board held at an angle relative to the connector 120 and the motherboard 202 to which the connector is mounted. Accordingly, the circuit board 204 may first be "toed" into the socket 222 during the connection process.

Figure 3B:
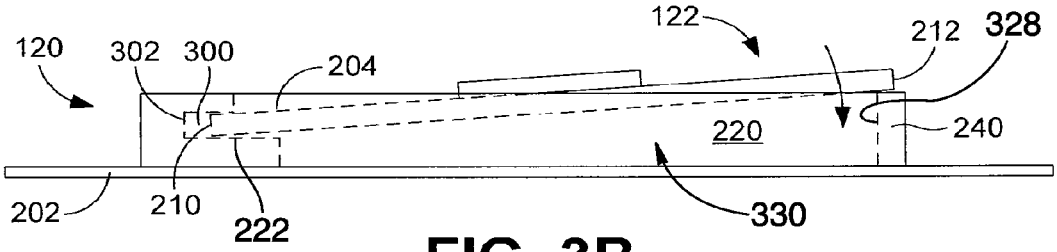

Once the front edge 210 of the module circuit board 204 has been toed into the socket 222, the rear edge 212 of the circuit board can be displaced downward toward the electrical connector 120 for the purpose of seating the module 122 within the connector 120. In cases in which the circuit board 204 has been only partially inserted into the socket 222, however, such seating is not possible. Such a situation is depicted in FIG. 3B. As shown in that figure, the circuit board 204 has not been fully inserted into the socket 222 as evidenced by a gap 300 that exists between the front edge 210 of the circuit board and a rear surface 302 of the socket. In such a case, a rear portion of the circuit board 204 will abut against the obstruction elements 240 provided at the distal ends of the lateral arms 220 to prevent the module 122 from seating within the connector 120, thereby communicating to the installer that the circuit board into fully inserted is not the socket 222.

Figure 3C:
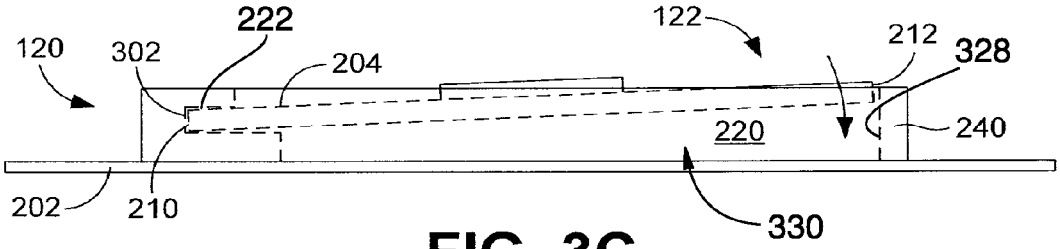
Figure 3D:
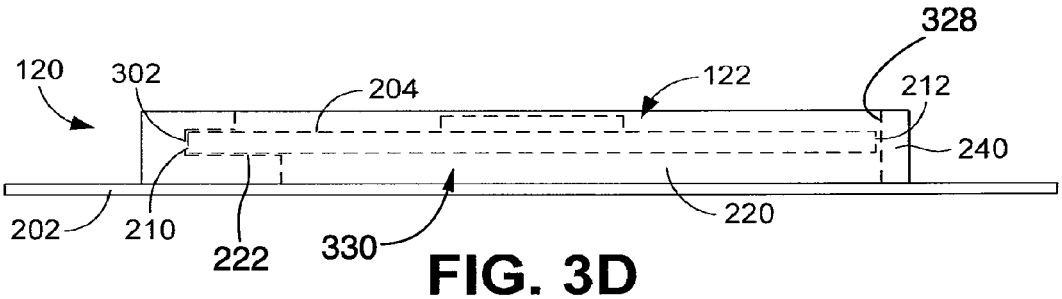
Figure 4:
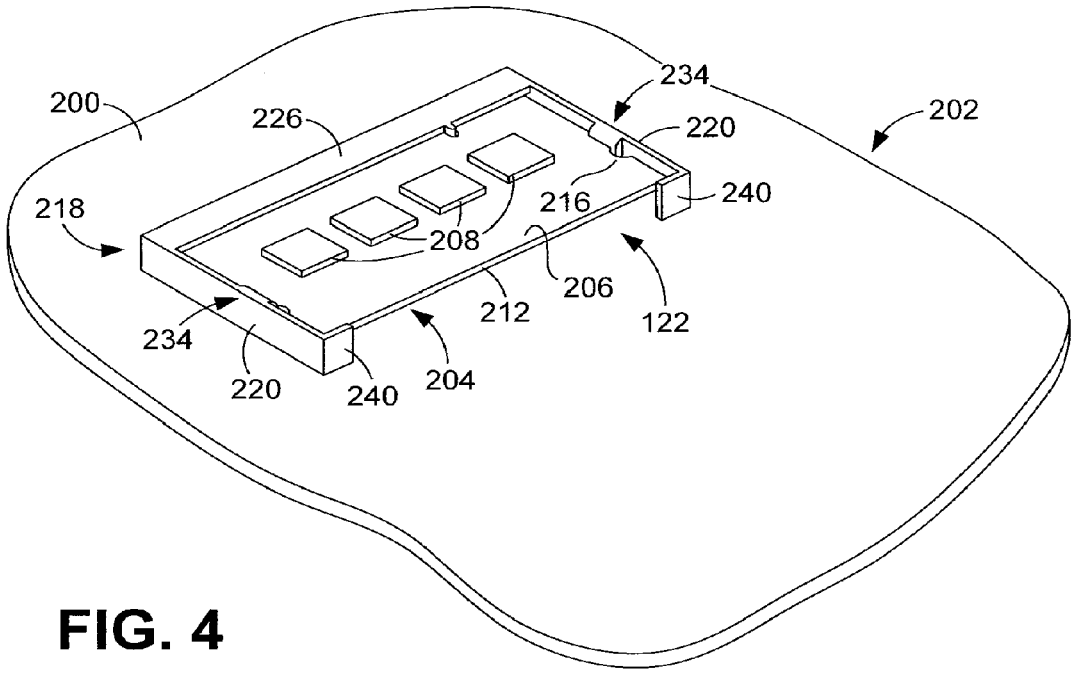
FIG. 4 is a partial perspective view of the connector of FIG. 2, illustrating a component module properly connected to and seated within the connector.

In contrast, when the module circuit board 204 is fully inserted into the socket 222, the module 122 will clear the obstruction elements 240, as depicted in FIG. 3C. Therefore, the module 122 can be seated within the electrical connector 120 as shown in FIG. 3D and FIG. 4. With reference to FIG. 3D, when the module 122 is properly seated within the connector 120, the front edge 210 of the module circuit board 204 is positioned adjacent the rear surface 302 of the socket 222, and the rear edge 212 of the circuit board is positioned inward of the obstruction elements 240. With reference to FIG. 4, the lateral edges 214 of the circuit board 204 are positioned between the arms 220 of the connector, and the circuit board is further engaged with and securely held in place by the locking elements 234. Specifically, the tab portions 236 are positioned within the recesses 216 of the circuit board 204 and the clip portions 238 contact and press down upon the top surface 206 of the circuit board.

The invention claimed is:

1. An electrical connector adapted to receive a component module, the connector comprising:

a body that defines a socket into which the module can be inserted, wherein the socket comprises integrated electrical contacts adapted to mate with contacts of the component module, wherein the socket is defined by a top cover and a ledge that comprises a top surface that supports the component module when the module is properly seated within the connector; and an obstruction element facing a rear wall of the socket and spaced from the rear wall to engage a distal end of the module when the module is fully inserted into the socket and wherein the obstruction element is adapted to physically interfere with the module when it is attempted to seat the module within the connector with the module only partially inserted into the socket.

2. The electrical connector of claim 1, further comprising lateral arms that extend outward from the body, the obstruction element being associated with at least one of the arms.

3. The electrical connector of claim 2, wherein the module is positioned between the lateral arms when the module is properly seated within the connector.

4. The electrical connector of claim 2, wherein the obstruction element is positioned at a distal end of at least one of the lateral arms.

5. The electrical connector of claim 2, wherein the obstruction element comprises a wall that is contiguous with at least one of the lateral arms.

6. The electrical connector of claim 2, wherein each lateral arm comprises an obstruction element positioned at a distal end of the arm.

7. The electrical connector of claim 2, wherein each lateral arm comprises a locking element that secures the component module to the connector when the module is properly seated within the connector.

8. The electrical connector of claim 1, wherein the obstruction element comprises a wall having a top obstruction surface and an uncovered vertically exposed cavity surface extending from the top obstruction surface while being directly opposite to and facing a rear surface of the socket at a fixed spacing with respect to the rear surface of the socket, the top obstruction surface being configured to permit pure pivotal movement of the component module into contact with the cavity surface while the component module is fully inserted into the socket.

9. The electrical connector of claim 1, wherein the body defines a cavity configured to receive the connection module and having a first opening facing in a first direction, the socket having a second opening facing in a second direction perpendicular to the first direction.

10. A surface-mounted electrical connector adapted to mount to a circuit board, the connector comprising a body that defines a socket into which a component module can be inserted, the socket including integrated electrical contacts adapted to mate with contacts of the module;

lateral arms that extend outward from the body, the arms defining lateral walls between which the module is positioned when the module has been properly seated within the connector, each arm comprising a distal end, and obstruction elements, one positioned at the distal end of each arm, the obstruction elements being adapted to physically interfere with the module when it is attempted to seat the module within the connector with the module only partially inserted into the socket, wherein the obstruction elements each comprise a wall having a top obstruction surface and an uncovered vertically exposed cavity surface extending from the top obstruction surface while being directly opposite to and facing a rear surface of the socket at a fixed spacing with respect to the rear surface of the socket, the top obstruction surface being configured to permit pure pivotal movement of the component module into contact with the cavity surface while the component module is fully inserted into the socket.

11. The electrical connector of claim 10, wherein the obstruction elements comprise walls that are contiguous with the lateral arms.

12. The electrical connector of claim 10, wherein each lateral arm comprises a locking element that secures the component module to the connector when the module is properly seated within the connector.

13. A computing device comprising:

a motherboard having a top surface; and an electrical connector mounted to the top surface of the motherboard, the connector having a cavity facing a first direction to receive a component module and comprising a body that defines a socket having a socket opening facing in a second direction perpendicular to the first direction and into which the component module can be inserted, wherein the socket comprises integrated electrical contacts adapted to mate with contacts of the component module, the socket having a rear surface, an upper surface and a lower surface facing the upper surface, lateral arms that extend outward from the body, and an obstruction element comprising a wall having a top obstruction surface and an uncovered vertically exposed cavity surface contiguously extending from the top obstruction surface while being directly opposite to and facing the rear surface at a fixed spacing with respect to the rear surface, the top obstruction surface adapted to physically interfere with the module when it is attempted to seat the connector module within the connector with the module only partially inserted into the socket.

14. The computing device of claim 13, wherein the obstruction element is positioned at a distal end of at least one of the lateral arms.

15. The computing device of claim 13, wherein the obstruction element comprises a wall that is contiguous with at least one of the lateral arms.

16. The computing device of claim 13, wherein each lateral arm comprises a locking element that secures the component module to the electrical connector when the module is properly seated within the connector.

17. The computing device of claim 13, wherein the cavity surface and the rear surface are at a fixed spacing with respect to one another so as to concurrently contact a front and a rear of the component module.

18. A method for preventing improper connection of a component module to an electrical connector, the method comprising:

providing an obstruction element on a circuit board to which the connector is mounted in a position in which the module cannot be seated within the connector if the module is only partially inserted within a socket of the connector, wherein the socket comprises integrated electrical contacts at least partially within the socket and adapted to mate with contacts of the component module, the socket having a rear surface, an upper surface and a lower surface facing the upper surface, the obstruction element comprising a wall having a top obstruction surface and an uncovered vertically exposed cavity surface extending from the top obstruction surface while being directly opposite to and facing the rear surface at a fixed spacing with respect to the rear surface, the top obstruction surface configured to permit pure pivotal movement of the component module into contact with the cavity surface while the component module is fully inserted into the socket.

19. The method of claim 18, wherein providing an obstruction element comprises integrating the obstruction element with the electrical connector.

20. The method of claim 19, wherein providing an obstruction element further comprises integrated the obstruction element with lateral arms that extend outward from a body of the electrical connector, the body defining the socket into which the component module can be inserted.

* * * * *